US008992338B2

(12) United States Patent
Willett et al.

(10) Patent No.: US 8,992,338 B2
(45) Date of Patent: Mar. 31, 2015

(54) GOLF CLUB HEAD WITH STEPPED CROWN

(71) Applicant: Taylor Made Golf Company, Inc., Carlsbad, CA (US)

(72) Inventors: Kraig Alan Willett, Fallbrook, CA (US); Nathan T. Sargent, Oceanside, CA (US); Joseph Reeve Nielson, Vista, CA (US); Michael Franz, San Diego, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 8 days.

(21) Appl. No.: 13/841,737

(22) Filed: Mar. 15, 2013

(65) Prior Publication Data

US 2014/0274448 A1 Sep. 18, 2014

(51) Int. Cl.
*A63B 53/04* (2006.01)

(52) U.S. Cl.
CPC ..... *A63B 53/04* (2013.01)
USPC ..... 473/327; 473/345

(58) Field of Classification Search
CPC ..... A63B 53/04
USPC ..... 473/327, 345
See application file for complete search history.

(56) References Cited

U.S. PATENT DOCUMENTS

| | | | | |
|---|---|---|---|---|
| 5,935,020 | A * | 8/1999 | Stites et al. | 473/345 |
| 7,789,773 | B2 | 9/2010 | Rae et al. | |
| 8,088,021 | B2 | 1/2012 | Albertsen et al. | |
| 2006/0079349 | A1 * | 4/2006 | Rae et al. | 473/345 |
| 2010/0016095 | A1 * | 1/2010 | Burnett et al. | 473/327 |
| 2013/0324293 | A1 * | 12/2013 | Stites et al. | 473/327 |

OTHER PUBLICATIONS

Tigershark, "Jim Flood Design/PowerPod Driver" Gallery, http://www.tigersharkgolf.com/jim-flood-design/powerpod-driver/gallery.html, 2 pgs.
Tigershark, "Jim Flood Design/PowerPod Driver" Overview, http://www.tigersharkgolf.com/jim-flood-design/powerpod-driver/, 2 pgs.

* cited by examiner

*Primary Examiner* — Michael Dennis
(74) *Attorney, Agent, or Firm* — Klarquist Sparkman, LLP

(57) ABSTRACT

Golf club head embodiments disclosed herein comprise a crown having a stepped portion located between a front portion of the crown and rear portion of the crown, such that the crown transitions steeply in height across the stepped portion from the front portion down to the rear portion. The stepped portion of the crown may extend from adjacent to the hosel in a toeward and rearward direction.

17 Claims, 17 Drawing Sheets

GOLF CLUB HEAD WITH STEPPED CROWN

FIELD

This disclosure concerns wood-type golf club heads having a stepped crown.

BACKGROUND

Wood-type golf club heads typically have a relatively flat, gently curved crown that extends rearwardly from near the top of the striking face. As the striking face of such club heads has increased in size in recent years, the elevation of the crown and overall volume of the club head has increased accordingly, which has led to increased aerodynamic drag on the club head during the down swing and an elevated the center of gravity of the club head.

SUMMARY

Described herein are wood-type golf club heads that comprise a crown having a stepped portion located between a raised front portion of the crown and lower rear portion of the crown, such that the crown transitions steeply in height across the stepped portion from the front portion down to the rear portion. The stepped portion of the crown can extend from a heelward side of the crown in a toeward and rearward direction. The stepped crown can provide improved aerodynamics during a swing and can lower the overall center of gravity of the club head.

In some embodiments, the stepped portion of the crown extends in a toeward and rearward direction that forms an average angle $\alpha$ of at least about 10°, at least about 20°, at least about 30°, and/or at least about 40° degrees relative to a plane perpendicular to the front-rear extending y-axis.

In some embodiments, the golf club head has a center of gravity having a z-coordinate of less than −1.4 mm, less than −2.0 mm, less than −3.0 mm, less than −4 mm, and/or less than −5 mm.

In some embodiments, the front portion of the crown is arched or bulbous, such that, with the golf club head resting on a horizontal planar ground surface in the address position, a highest point of the striking face has a first height in the z-direction above the ground surface and a highest point of the crown has a second height in the z-direction above the ground surface, and the ratio of the second height divided by the first height is at least about 1.13, at least about 1.21, and/or at least about 1.25.

In some embodiments, the external surfaces of the front portion of the crown, the stepped portion of the crown, and/or the rear portion of the crown are non-concave and/or convex.

In some embodiments, a front edge of the stepped portion of the crown at an x-coordinate of zero has a y-coordinate of at least about 20 mm, at least about 30 mm, and/or at least about 40 mm.

In some embodiments, an aerodynamic drag of the club head is less than about 800 grams, less than about 700 grams, and/or less than about 600 grams at a relative air velocity of 120 mph, a pitch angle of 0°, and a beta angle of 20°.

The foregoing and other objects, features, and advantages of the disclosed technology will become more apparent from the following detailed description, which proceeds with reference to the accompanying figures.

DETAILED DESCRIPTION

Figure 1:
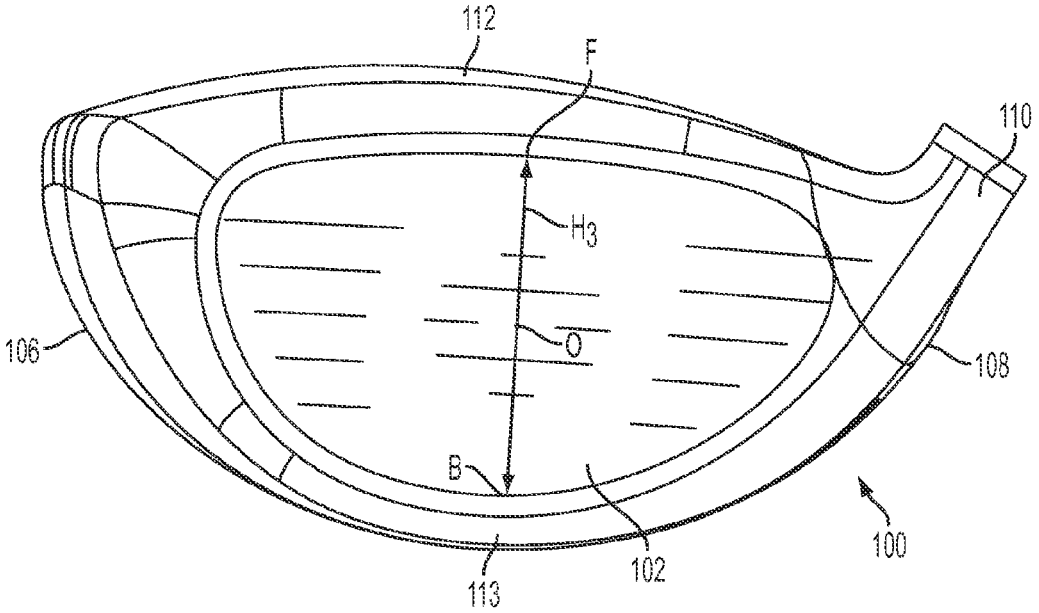
FIG. 1 is a front view of an exemplary golf club head with a stepped crown.

Described herein are embodiments of wood-type golf club heads having improved aerodynamic performance and a low center of gravity. Some embodiments include a large striking face, an arched or bulbous front crown portion, a stepped-down transition portion of the crown that extends both toeward and rearward from a heelward side of the crown, and a relatively low rear portion of the crown. The stepped crown can provide improved aerodynamics and can lower the overall center of gravity of the club head.

Golf club heads are described herein with reference to an orthogonal x, y, and z coordinate system. The origin "O" (see FIGS. 1 and 8A) is a point where x=0, y=0, and z=0, and is located at the geometric center point of the external surface of the striking face, or the "centerface," of the club head, as defined by the methodology described in U.S.G.A. "Procedure for Measuring the Flexibility of a Golf Clubhead," Revision 2.0. In this U.S.G.A. methodology, the geometric center point of the external surface of the striking face is defined as the intersection of the midpoints of a height (Hss) and a width (Wss) of the striking face. Both Hss and Wss are determined using the striking face curve (Sss). The striking face curve Sss is bounded on its periphery by all points where the face transitions from a substantially uniform bulge radius (face heel-to-toe radius of curvature) and a substantially uniform roll radius (face crown-to-sole radius of curvature) to the body. Hss is the distance from the periphery proximate to the sole portion of Sss (also referred to as the bottom radius of the striking face) to the periphery proximate to the crown portion of Sss (also referred to as the top radius of the striking face) measured in a vertical plane (perpendicular to ground) that extends through the center of the striking face (e.g., this plane is substantially normal to the x-axis). Similarly, Wss is the distance from the periphery proximate to the heel portion of Sss to the periphery proximate to the toe portion of Sss measured in a horizontal plane (e.g., substantially parallel to ground) that extends through the center of the striking face (e.g., this plane is substantially normal to the z-axis). In other words, the center along the z-axis corresponds to a point that bisects into two equal parts a line drawn from a point just on the inside of the top radius of the striking face (and centered along the x-axis of the striking face) to a point just on the inside of the bottom radius of the striking face (and centered along the x-axis of the striking face). In some embodiments, the striking face 102 can comprise a striking plate or face plate attached to the body 110 using known attachment techniques.

As defined herein, the x-axis extends in the heel-toe directions of the club head, passing through the origin O tangential to the striking face and parallel to the ground plane, with positive x-values being in the direction from the origin O toward the heel of the club head. The y-axis extends in the front-rear directions through the centerface and perpendicular to a plane tangent to the centerface and parallel with the ground plane, with positive y-values being in the direction from the centerface toward the rear of the club head. Finally, the z-axis extends in the sole-crown directions of the club head, passing through the origin O and being perpendicular to the ground plane, with positive z-values being in the direction from the origin O toward the crown of the club head. Unless otherwise stated, the x, y and z axes are defined in relation to a planar ground surface with the club head resting on the ground surface in the normal address position, such that the x-y plane is parallel to the ground plane and the z-axis is perpendicular to the ground plane.

Wood-type golf club heads typically comprise a striking face at a front end, a rear end, a toe, a heel, a hosel, a sole, and a crown. In embodiments disclosed herein, the crown comprises a front portion, a rear portion, and a stepped portion between the front and rear portions with the stepped portion decreasing in the z-direction down to the rear portion of the crown of the club head. The external surface of the stepped portion can have a slope, or angle of declination μ (see FIGS. 4 and 7D), defined as the angle of a plane tangent to the external surface of the crown at a given point, relative to a horizontal x-y plane. The angle of declination μ along the stepped portion of the crown can be relatively large, or steep, compared to the adjacent external surfaces of the front portion of the crown and the rear portion of the crown, which can present an abrupt change in elevation in the z-direction. A relatively steep stepped portion can provide a reduction in aerodynamic drag and/or a lower center of gravity relative to golf club head having a traditionally flat crown without a stepped portion.

The steepness of declination of the stepped portion of the crown moving from the front portion of the crown toward the rear portion of the crown can be such that the maximum angle of declination μ is at least 50°, at least 60°, at least 70°, or at least 80°. In some embodiments, the stepped portion of the crown can comprise a region of the crown wherein substantially the entire external surface of the region has an angle of declination μ of at least 50°, at least 60°, at least 70°, or at least 80°. In some embodiments, the external surface of the front portion of the crown and the rear portion of the crown can have an angle of declination μ of less than 80°, less than 70°, less than 60°, and/or less than 50° immediately adjacent to the stepped portion of the crown, such that the stepped portion of the crown provides a relatively steep transition between the front and rear portions of the crown.

Figure 2:
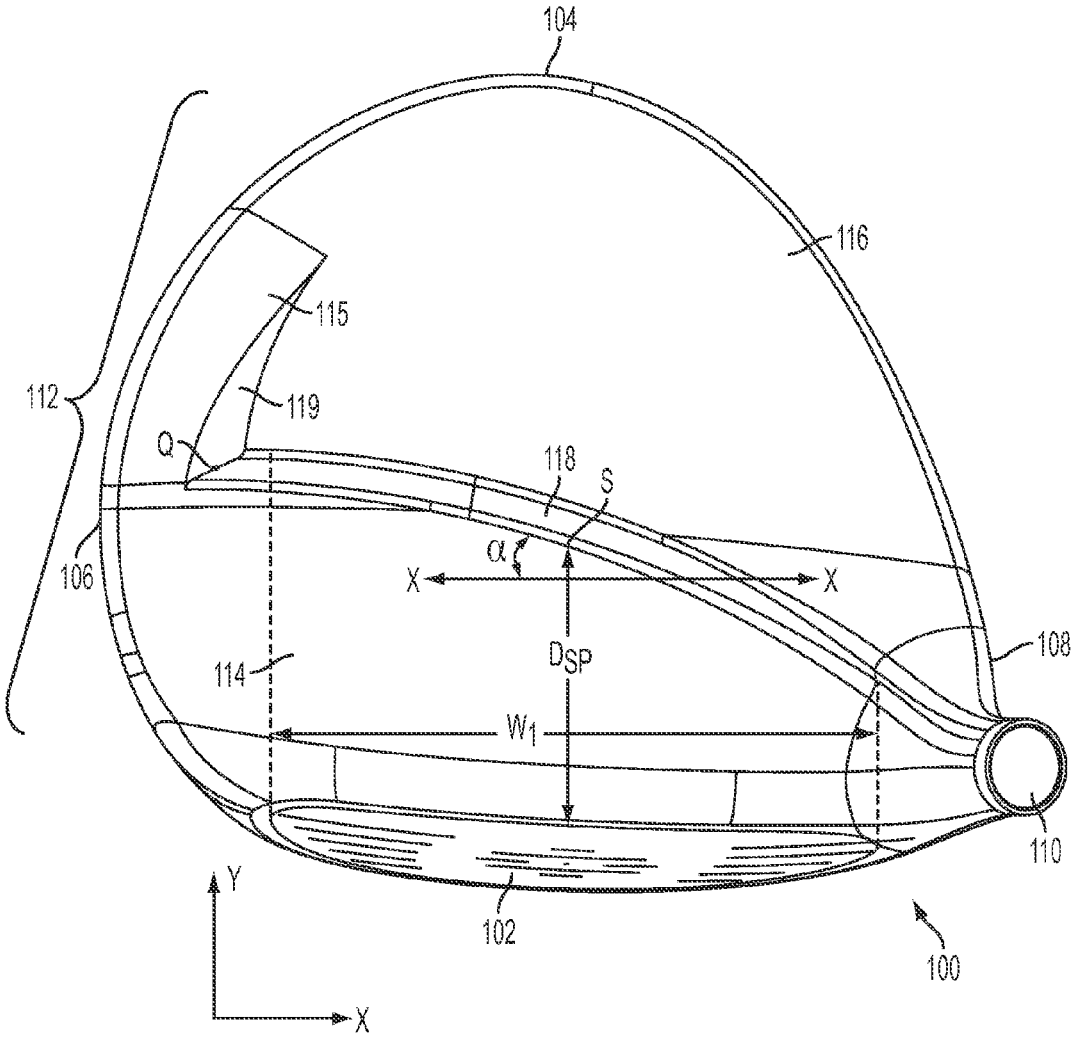
FIG. 2 is a top view of the exemplary golf club head of FIG. 1.
Figure 8A:
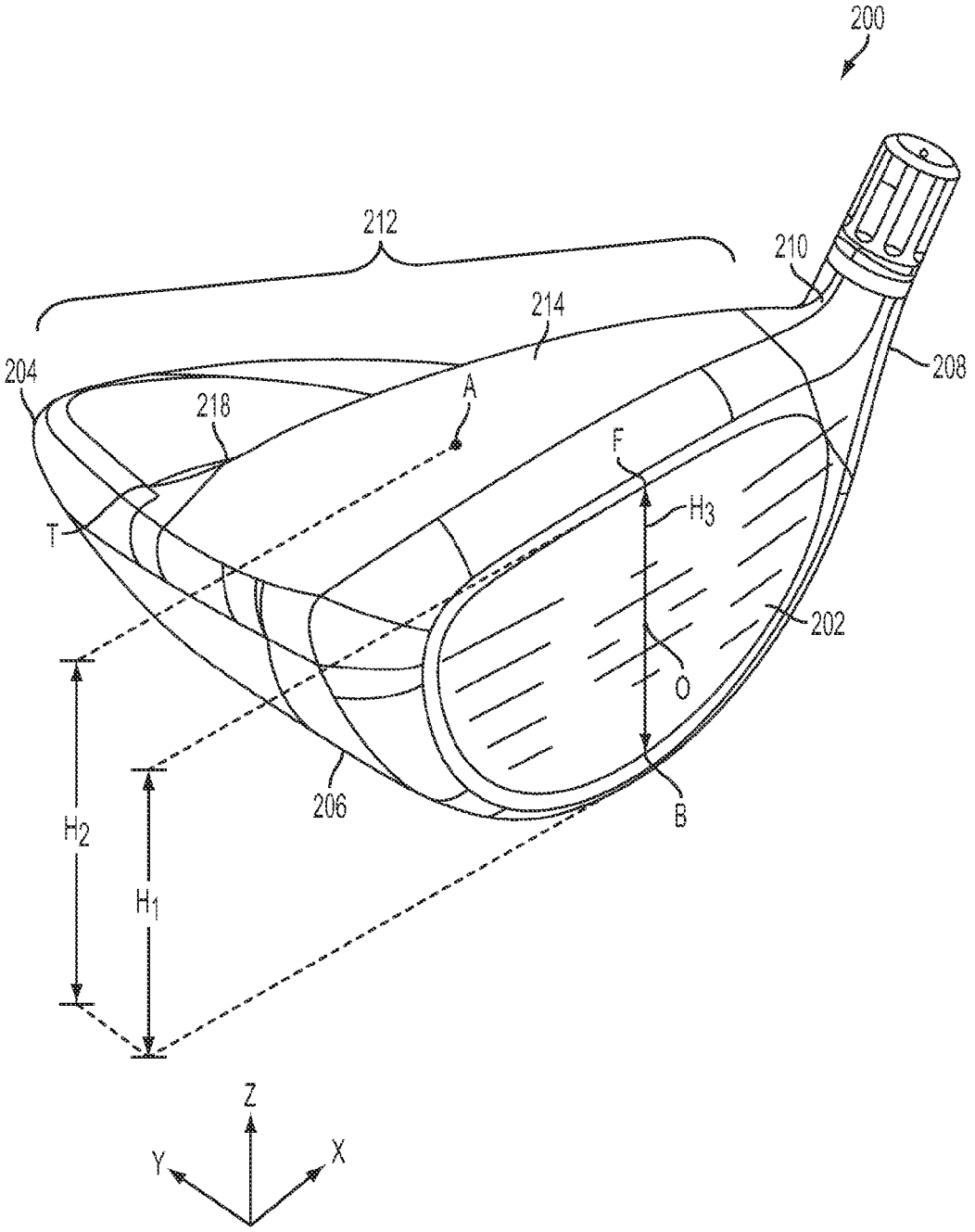
FIG. 8A is a perspective view of another exemplary golf club head with a stepped crown.
Figure 8B:
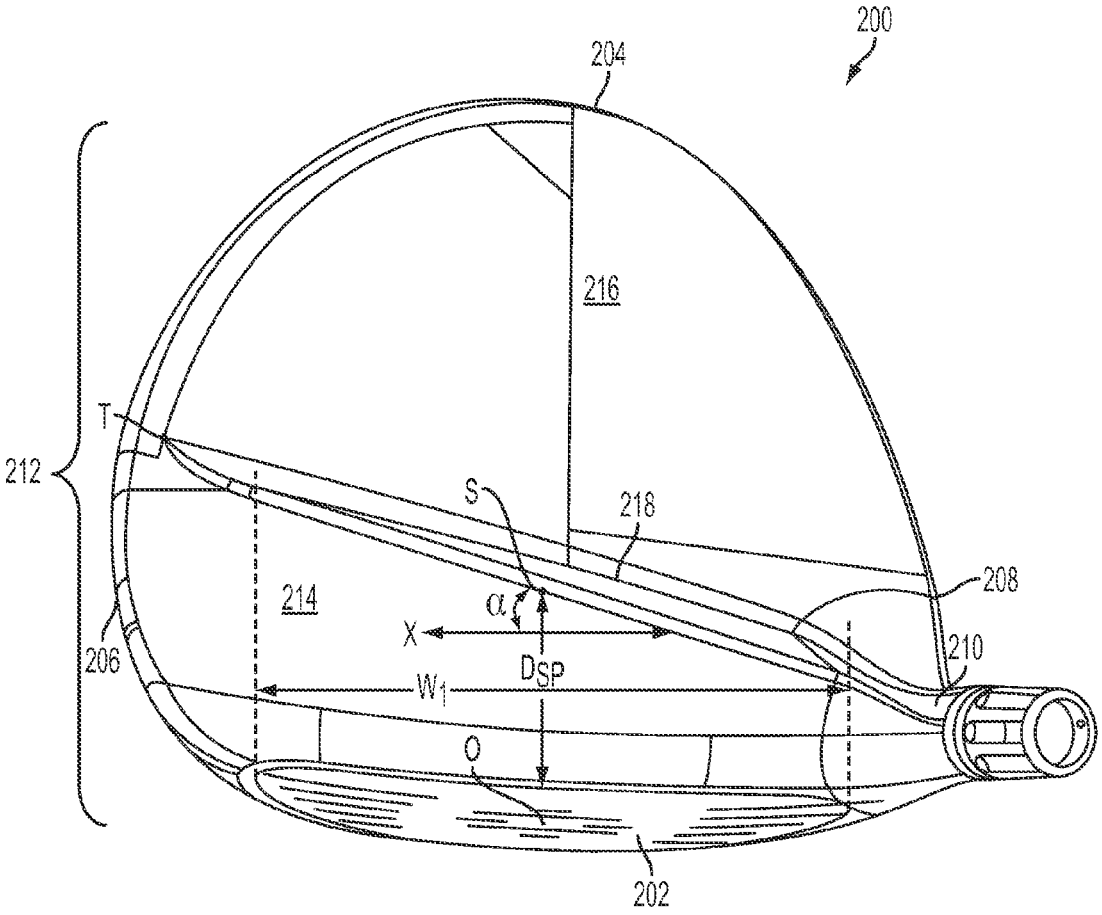
FIG. 8B is a top view of the golf club head of FIG. 8A.

The stepped portion of the crown can extend from a heel side of the crown, such at or near the hosel 110, or rearward of the hosel, in a toeward and rearward direction across the crown (see e.g., FIGS. 2 and 8B). The stepped portion of the crown can extend in a generally straight path in some embodiments (see e.g., FIG. 8B) and can extend in a curved path in some embodiments (see e.g., FIG. 2). The rearward and toeward course of the stepped portion of the crown can form an average angle α relative to an x-z plane, as shown in FIGS. 2 and 8B. In some embodiments, the average angle α can be at least about 10°, at least 20°, at least 30°, and/or at least about 40°. The average angle α can be defined as the average angle over a certain range of the stepped portion of the crown, such as a range of the stepped portion of the crown of from about +40 mm in the x-axis to about −40 mm in the x-axis.

For example, with reference to FIG. 2, the stepped portion of the crown 118 is curved causing the angle α to vary along its length. In such an embodiment, the average angle α can be measured over a range of the length of the stepped portion 118. Such a range can have any length, such as about 40 mm, about 60 mm, or about 80 mm, and/or can be centered about the x=0 plane. In some embodiments, the range of the stepped portion 118 over which the average angle α is measured can be equal to the width $W_1$ of the striking face 102 along the x-axis. In some embodiments, for example, the range of the stepped portion 118 over which the average angle α is measured can extend from about +40 mm in the x-axis to about −40 mm in the x-axis. In some embodiments, the angle α of the stepped portion of the crown at the x=0 plane can be at least about 10°, at least 20°, at least 30°, and/or at least about 40°.

In some embodiments, the external surfaces of the front portion of the crown (e.g., 114) and the rear portion of the crown (e.g., 116) of the golf club head can be non-concave and/or convex. In some embodiments, the entire external surface of the front portion of the crown and/or the entire external surface of the rear portion of the crown of the golf club head can be non-concave and/or convex. For example, in the embodiment 100 of FIG. 4, the front portion 114 of the crown 112 has a convex external surface and the rear portion 116 of the crown 112 has a convex external surface.

The stepped portion of the crown can also have non-concave and/or convex external surface. In some embodiments, the entire crown of the club head has non-concave and/or convex external surface. The external surface of the stepped portion of the crown can have a convex curvature in the heel-toe direction. The external surface of the stepped portion of the crown can have a curvature in the front-rear directions that is partially convex, partially flat, and/or partially concave.

In conventional wood-type club heads with a large striking face, the oversized striking surface often results in a relatively large z-coordinate of the club head center of gravity, referred to herein as "CGz". However, the disclosed club heads can comprise a large striking face with a relatively lower CGz. In some embodiments, CGz can be less than or equal to about −1.4 mm, less than or equal to about −2 mm, less than or equal to about −2.5 mm, less than or equal to about −3 mm, less than or equal to about −3.5 mm, less than or equal to about −4 mm, less than or equal to about −4.5 mm, and/or less than or equal to about −5 mm, such as about −5.09 mm in one example.

Such a low CGz can be accomplished in part by providing a stepped crown having a rear portion and/or heel portion that is lower in the z-direction. The low CGz can be accomplished in part by relocating mass in stepped portion and rear portion of the crown toward the sole of the club head.

In some embodiments, the club head can comprise one or more adjustable weights or weighted tabs or other dense objects in or adjacent to the sole of the club head to further lower the CGz of the club head. In some embodiments, one or more weights can be positioned in one or more ports located in or adjacent to the sole, heel, toe, and/or rear of the club head. In some embodiments, the club head CGz can be adjusted by repositioning one or more moveable weights.

In conventional wood-type club heads, the full non-stepped crown can result in a relatively large x-coordinate of the club head center of gravity, referred to herein as "CGx". However, the disclosed club heads can comprise a relatively smaller (or more toeward) CGx. In some embodiments, CGx can be less than or equal to about 2.1 mm, less than or equal to about 2.0 mm, less than or equal to about 1.8 mm, less than or equal to about 1.6 mm, less than or equal to about 1.4 mm, less than or equal to about 1.2 mm, less than or equal to about 1.0 mm, and/or less than or equal to about 0.95 mm, such as about 0.93 mm in one example.

The stepped portion of the crown can be located at a front-to-rear distance $D_{sp}$ (e.g., see FIGS. 2 and 8B) along the y-axis from the top of the striking face at x=0 to the front edge of the stepped portion of the crown at y=0 (marked as point S in FIGS. 2 and 8B). The distance $D_{sp}$ can also be characterized as the depth in the y-direction of the front portion of the crown at x=0. If $D_{sp}$ is relatively small, and thus the front portion of the crown has relatively small depth, there can be insufficient mass and/or structural support behind the upper portion of the striking face. Additionally, a club head wherein the front portion of the crown is relatively shallow can have inferior aerodynamic performance. Thus, it can be desirable for the front portion of the crown to have at least a certain depth in the y-direction. For example, in some embodiments, $D_{sp}$ can be at least 20 mm, at least 25 mm, at least 30 mm, at least 35 mm, at least 40 mm, at least 45 mm, at least 50 mm, at least 55 mm, and/or at least 60 mm.

However, if $D_{sp}$ is relatively large, the deep front portion of the crown can limit the reduction of CGz provided by the stepped crown, as described above, and/or can result in increased aerodynamic drag. Thus, in some embodiments, $D_{sp}$ can less than 80 mm, less than 70 mm, less than 60 mm, less than 50 mm, and/or less than 40 mm.

In some embodiments, a club head having a stepped crown can provide improved aerodynamic performance during the downswing by providing a smaller club head profile in the direction of motion of the club head at various club head orientations during the downswing. During the downswing, as the club head is moved through the air, it encounters a drag force due to wind resistance. During the downswing, the club head can rotate (e.g., about the shaft axis) such that a vector normal to the centerface of the club head is not pointing in the same direction as the direction of motion of the club head. Rotation of the club head during the downswing has the result that the wind resistance encountered by the club head is not consistently normal to the striking face of the club head. Rather, the direction of the wind resistance varies as the club head moves from the top to the bottom of the downswing. Those skilled in the art will recognize that these effects can be described and accounted for in determining the drag forces encountered by the club head by accounting for the "pitch" angle and "beta" angle of the club head relative to the wind direction.

The angle that a vector normal to the centerface makes relative to the direction of motion of the club head can have two orthogonal components. The component in the x-axis (i.e., degree of rotation of the club head about the z-axis relative to the direction of motion of the club head) is defined as the "beta" angle, while the component in the z-axis (i.e., degree of rotation of the club head about the x-axis) is defined as the "pitch" angle. As illustrated in FIGS. 9E and 9F, when the beta angle and the pitch angle are both equal to zero, the vector normal to the centerface is aligned with the direction of motion of the club head. Positive beta angles are illustrated in FIGS. 9A-9D, wherein the heel side of the club head leads ahead of the toe side of the club head. During a typical downswing, the beta angle of a club head is often non-zero and positive, presenting a different club head profile to the oncoming airflow, which can significantly change the aerodynamic drag of the club head compared to a beta angle of zero.

Figure 9A:
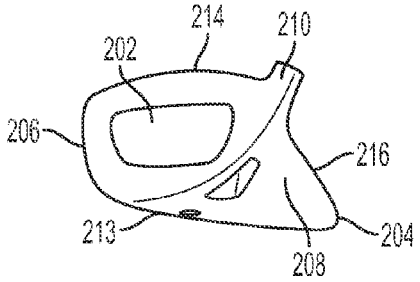
FIG. 9A is a profile view of the golf club head of FIG. 8A in the direction of relative air motion at a first beta angle.
Figure 9B:
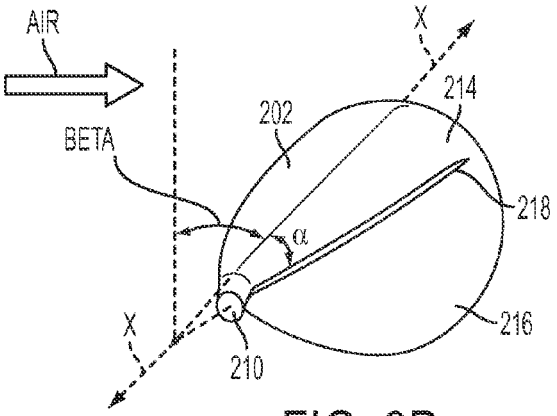
FIG. 9B is a top view of the golf club head of FIG. 8A at the first beta angle.

FIGS. 9A and 9B show an exemplary club head 200 at a beta angle of about 45°. FIG. 9A shows the club head profile in the direction of motion of the club head at beta angle of about 45°. From the top view of FIG. 9B, the direction of motion of the air relative to the club head 200 is generally left-to-right. As shown in FIG. 9A, a rear-heel portions 208, 204 of the exemplary club head are exposed to direct oncoming airflow when the club head is turned at a large beta angle. Embodiments of a club head having a stepped crown with a lowered rear portion of the crown can present a reduced profile area at positive beta angles, as shown in FIG. 9A, as the profile area of the rear portion 216 of the crown is significantly reduced.

Figure 10A:
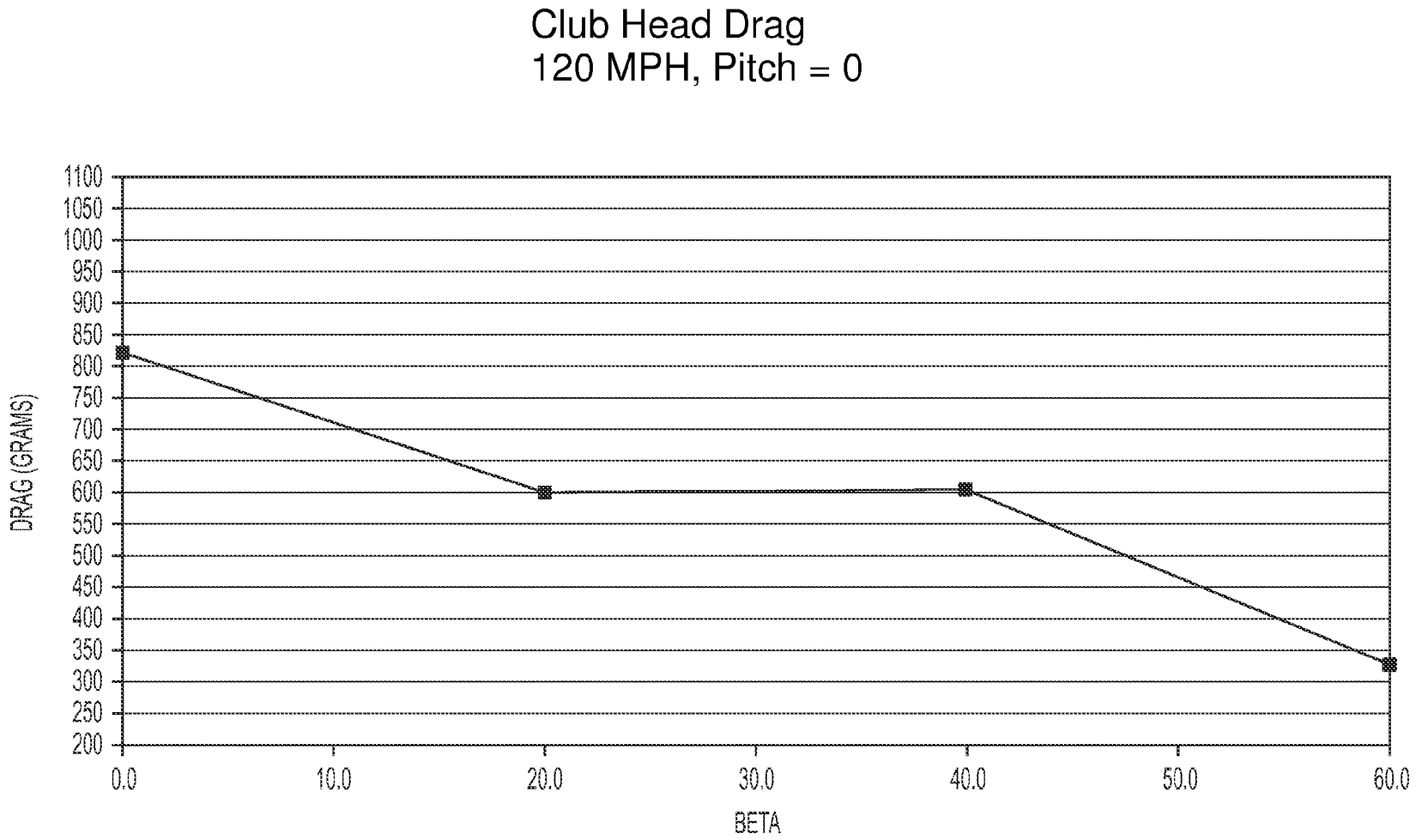
FIGS. 10A-10C are graphs showing aerodynamic drag of an exemplary golf club head at various orientations relative to air motion.
Figure 10B:
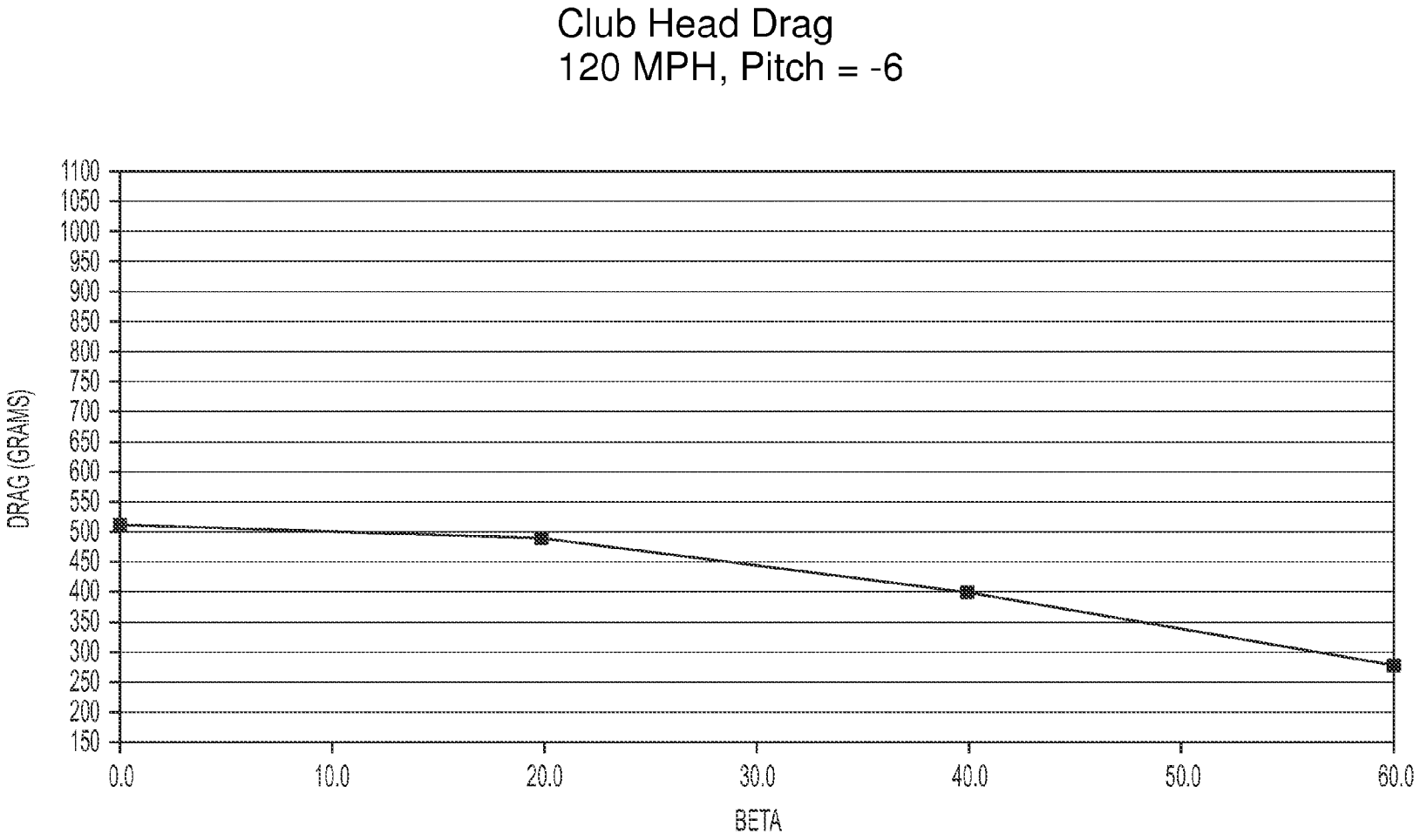
Figure 10C:
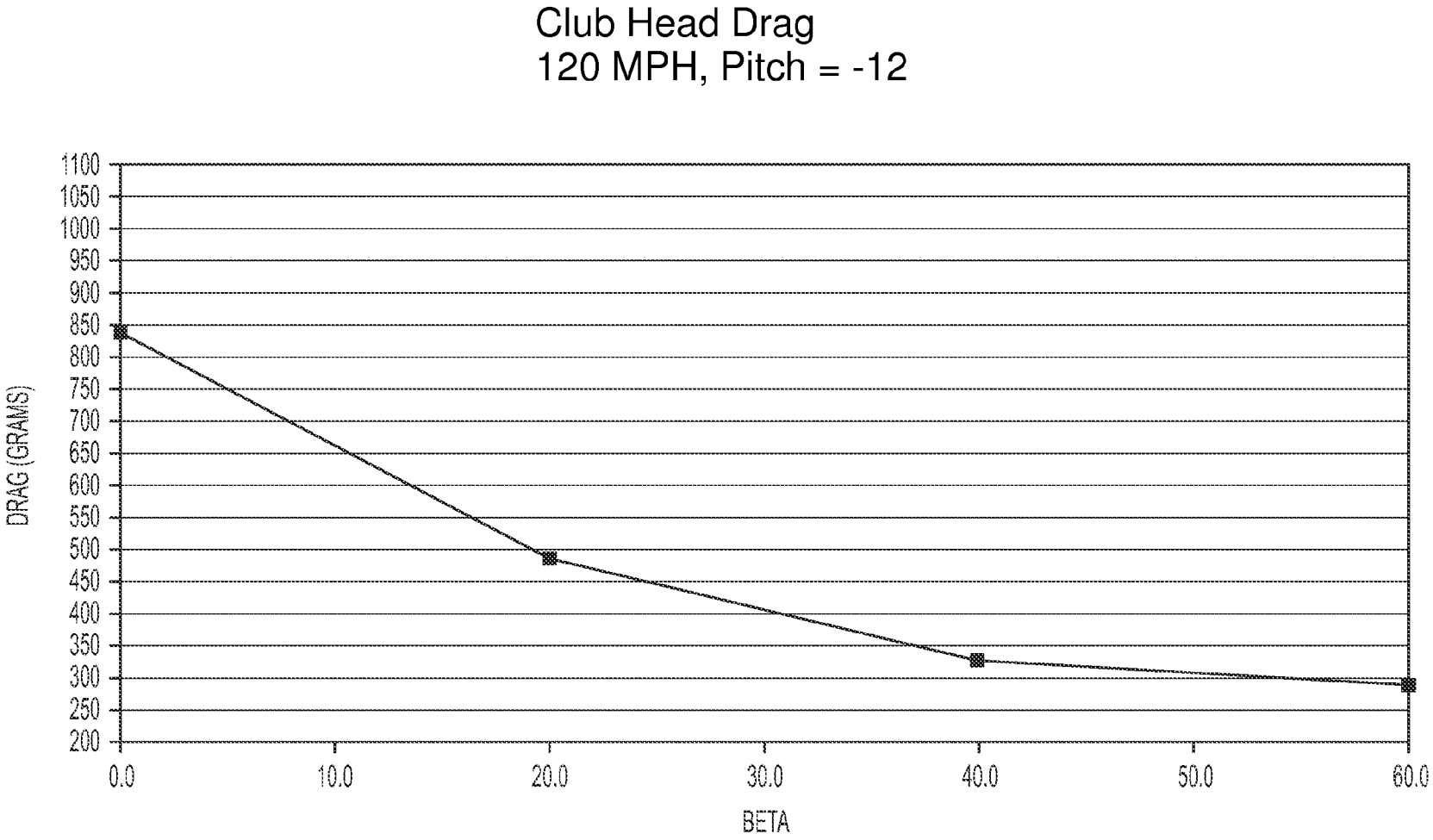

FIGS. 10A-10C show exemplary test data regarding the aerodynamic drag of the exemplary club head 200. FIG. 10A shows the amount of drag measured as a function of beta angle when the club head is subjected to wind at 120 miles per hour, and at a pitch angle of 0°. FIG. 10B shows the amount of drag measured as a function of beta angle when the club head is subjected to wind at 120 miles per hour, and at a pitch angle of −6°. FIG. 10C shows the amount of drag measured as a function of beta angle when the club head is subjected to wind at 120 miles per hour, and at a pitch angle of −12°. For each pitch angle, data was recorded for beta angles of 0°, 20°, 40°, and 60°.

Figure 9C:
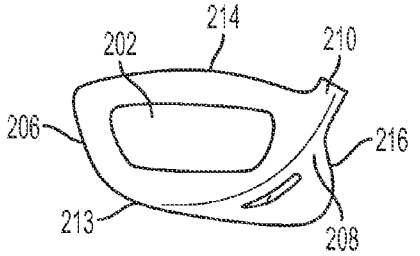
FIG. 9C is a profile view of the golf club head of FIG. 8A in the direction of relative air motion at a second beta angle.

As shown in FIGS. 10A-10C, the aerodynamic drag generally decreases as beta angle increases from 0° to 20° to 40° and to 60°. This decrease in drag at higher beta angles can be at least partly attributed to the reduce profile of the rear portion of the club head 200, as shown in FIGS. 9A and 9C, due to the stepped down crown. Even when the beta angle is 0°, the club head 200 can have a drag of less than 1000 grams, less than 900 grams, and/or less than 850 grams at a pitch angle of 0°. At a pitch angle of −6° and a beta angle of 0°, the club head 200 can have a drag of less than 1000 grams, less than 900 grams, less than 800 grams, less than 700 grams, less than 600 grams, and/or less than 550 grams. And at a pitch angle of −12° and a beta angle of 0°, the club head 200 can have a drag of less than 1000 grams, less than 900 grams, and/or less than 850 grams.

As the beta angle increases, the drag can decrease. At a beta angle of 20°, the club head 200 can have a drag of less than 800 grams, less than 700 grams, less than 600 grams, less than 550 grams, and/or less than 500 grams, for each of the pitch angles 0°, −6°, and −12°. At a beta angle of 40°, the club head 200 can have a drag of less than 800 grams, less than 700 grams, less than 600 grams, less than 500 grams, less than 400, and/or less than 350 grams, for each of the pitch angles 0°, −6°, and −12°. And at a beta angle of 60°, the club head 200 can have a drag of less than 600 grams, less than 500 grams, less than 400 grams, less than 350 grams, and/or less than 300 grams, for each of the pitch angles 0°, −6°, and −12°.

Figure 3:
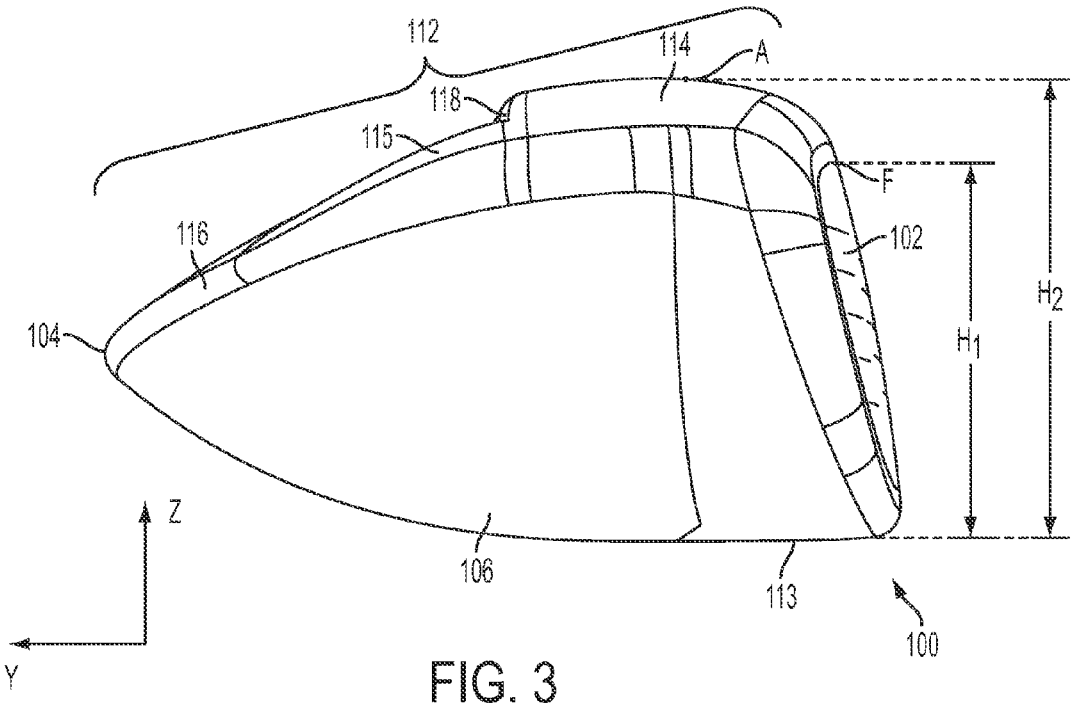
FIG. 3 is a toe side view of the exemplary golf club head of FIG. 1.

Some embodiments disclosed herein can have a relatively high apex ratio. The apex ratio is defined as the ratio of the height in the z-axis from the ground (in the address position) of the highest point on the crown (the "apex") divided by the height in the z-axis from the ground of the highest point of the striking face (in the address position). For example, as shown in FIGS. 3 and 8A, the apex ratio of the club head is equal to the value of $H_2$ (the height of the apex A) divided by the value of $H_1$ (the height of the top of the face F). A larger apex ratio can provide reduced aerodynamic drag, as the high apex on the front portion of the crown encourages a smooth airflow over the crown, and can encourage reattachment of airflow to the crown closer to the face. Earlier reattachment of airflow can provide smaller aerodynamic drag force and better aerodynamic performance. Conventional high volume, large moment-of-inertia wood-type golf club heads can have relatively flat crowns that do not extend very far, if at all, in the z-axis above the top of the striking face. Thus, most large-faced wood-type golf club heads have apex ratios of around 1.0. While such dub heads may appear as though they provide reduced drag, the opposite is often true with such club heads achieving poor airflow reattachment characteristics and increased aerodynamic drag forces. By contrast, some embodiments of the disclosed club heads can have an apex ratio of at least about 1.13, at least about 1.21, and/or at least about 1.25.

The striking face has a maximum width $W_1$ in the x-axis (e.g., see FIG. 2) and a maximum height $H_3$ in the z-axis (e.g., see FIG. 1). In some embodiments, $W_1$ can be greater than 60 mm, greater than 70 mm, greater than 80 mm, greater than 90 mm, and/or greater than 100 mm. In some embodiments, $H_3$ can be greater than 30 mm, greater than 40 mm, greater than 50 mm, greater than 55 mm, and or greater than 60 mm. The overall height $H_2$ from the ground to the apex of the crown A in the z-axis can be greater than 50 mm, greater than 60 mm, greater than 65 mm, greater than 70, and/or greater than 75 mm. The height $H_1$ from the ground to the top of the face F of the crown in the z-axis can be greater than 35 mm, greater than 45 mm, greater than 55 mm, greater than 60, and/or greater than 65 mm, and/or the height $H_1$ can be less than 70 mm, less than 65 mm, less than 60 mm, less than 55 mm, less than 50 mm, less than 45 mm, and/or less than 40 mm. For example, in one embodiment, $H_2$ is about 68.4 mm and $H_1$ is about 54.7 mm, and the apex ratio of $H_2/H_1$ is about 1.25.

Some club heads disclosed herein can have large front-to-rear, or y-axis, dimensions. For example, some embodiments have an overall front-to-rear dimension that is at least 116.8 mm, or even further a front-to-rear dimension that is at least 120.6 mm. Such embodiments can have a high volume golf club head with high moment of inertia values without sacrificing club head speed due to excessive aerodynamic drag forces.

The club head also has a volume, typically measured in cubic-centimeters ($cm^3$), equal to the volumetric displacement of the club head, assuming any apertures are sealed by a substantially planar surface, using the method described in the Procedure for Measuring the Club Head Size of Wood Clubs, Revision 1.0, Section 5 (Nov. 21, 2003), as specified by the United States Golf Association (USGA) and the R&A Rules Limited (R&A). Some club heads disclosed herein can have a volume at least about 200 $cm^3$, at least about 270 cm3, at least about 360 $cm^3$, at least about 400 $cm^3$, at least about 420 $cm^3$, and/or at least about 470 $cm^3$, for example between about 400 $cm^3$ and about 470 $cm^3$.

EXAMPLE 1

FIGS. 1-7 depict an exemplary golf club head 100 comprising a striking face 102, a rear end 104, a toe 106, a heel 108, a hosel 110, a sole 113, and a crown 112. The crown 112 comprises a front portion 114, a rear portion 116, and a stepped portion 118.

Figure 5:
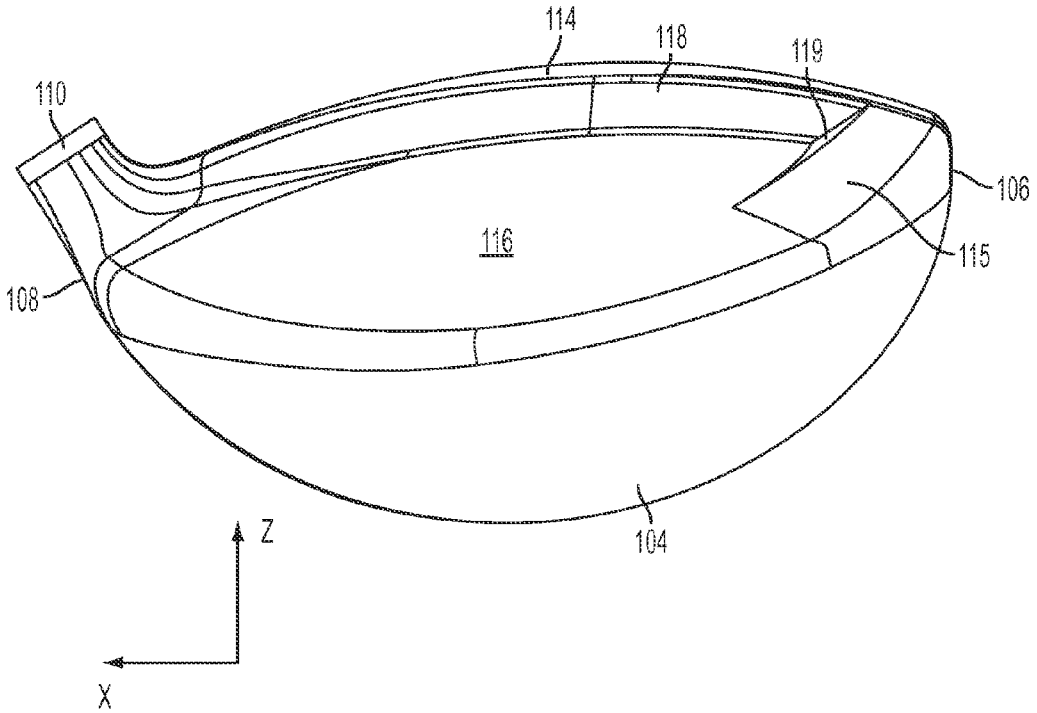
FIG. 5 is a rear view of the exemplary golf club head of FIG. 1.
Figure 6:
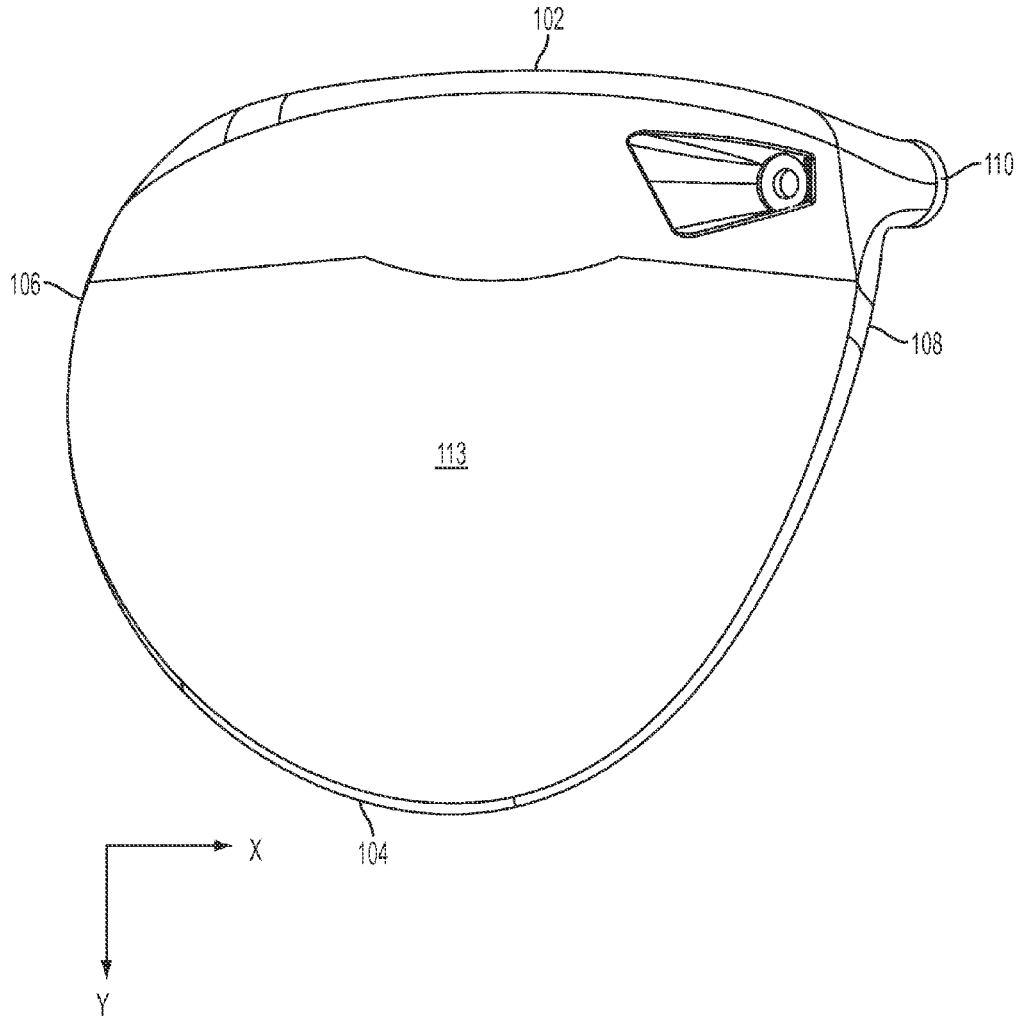
FIG. 6 is a bottom view of the exemplary golf club head of FIG. 1.

As shown in FIG. 2, the stepped portion 118 extends along a curved course from near the heel 108, such as at or near the hosel 110, in a toeward and rearward direction. This curved course extends to a point Q that is short of the toe end 106 of the club head, and then extends rearwardly with a gradual tapering in height towards the rear end 104, as shown in the rear view of FIG. 5. The front portion 114 of the crown increases in depth (y-dimension) moving toward the toe 106, and comprises a rearwardly extending portion 115 between the toe 106 and the rearwardly extending part 119 of the stepped portion 118, as shown in FIG. 5.

As shown in FIG. 2, the angle α of the stepped portion 118 at point S (at x=0) is about 30° relative to the x-z plane. In the embodiment 100, the front-to-rear distance $D_{sp}$ along the y-axis from the center-top of the striking face 102 to the point S at the front edge of stepped portion 118 at x=0 is about 40 mm. The width of the striking face 102 along the x-axis, $W_1$, is about 90 mm and the front-to-rear distance along the x-axis of the club head 100 is about 120 mm.

As shown in FIG. 3, with the golf club head 100 resting on a ground surface in the address position, a highest point F of the striking face 102 has a first height $H_1$ above the ground surface and the highest point A of the crown 112 has a second height $H_2$ above the ground surface. As shown in FIG. 1, the highest point F of the striking face 102 and the highest point A on the crown 112 are located closer to toe 106 of the club head 100 than the heel 108.

Figure 4:
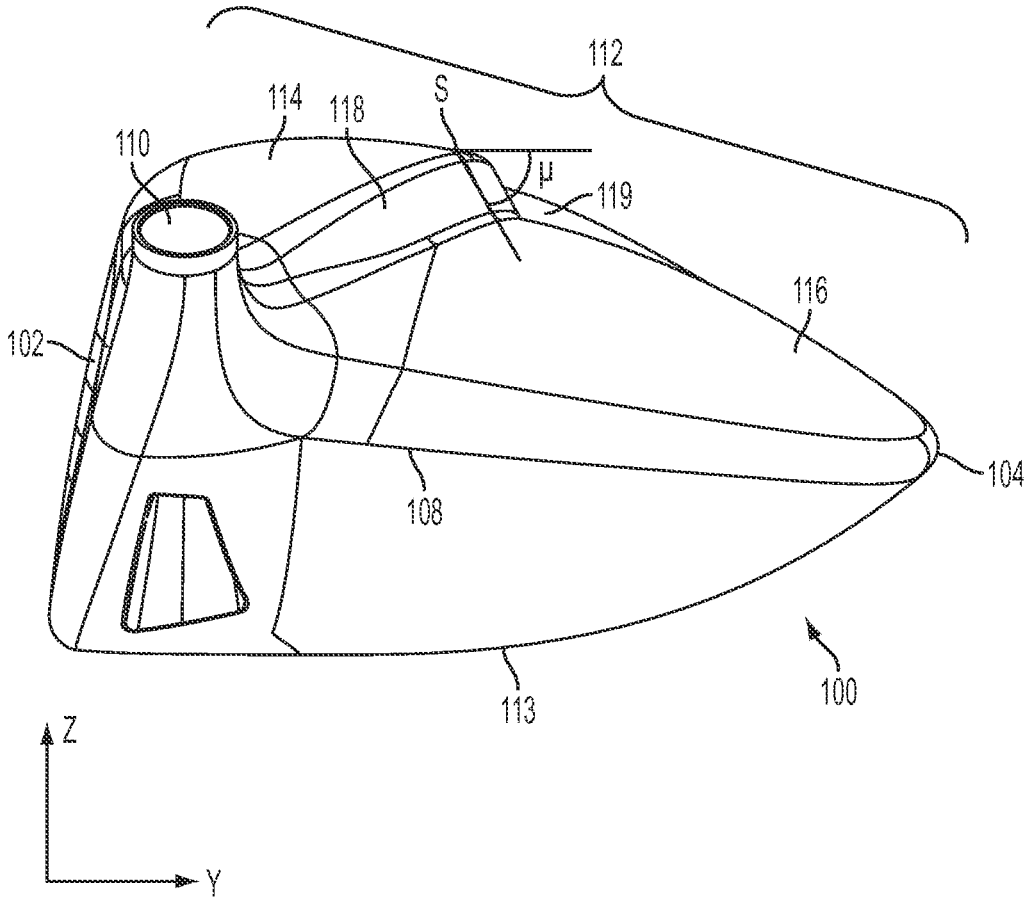
FIG. 4 is a heel side view of the exemplary golf club head of FIG. 1.

FIG. 4 shows the heel-side elevation view of the club head 100, showing the steep slope of the stepped portion 118. As shown in FIG. 4, the stepped portion 118 of the crown 112 falls off at a relatively steep angle of declination μ relative to the relatively reduced slope of the adjacent portion of front portion 114 of the crown and the relatively reduced slope of the rear portion of the crown 116.

Figure 7A:
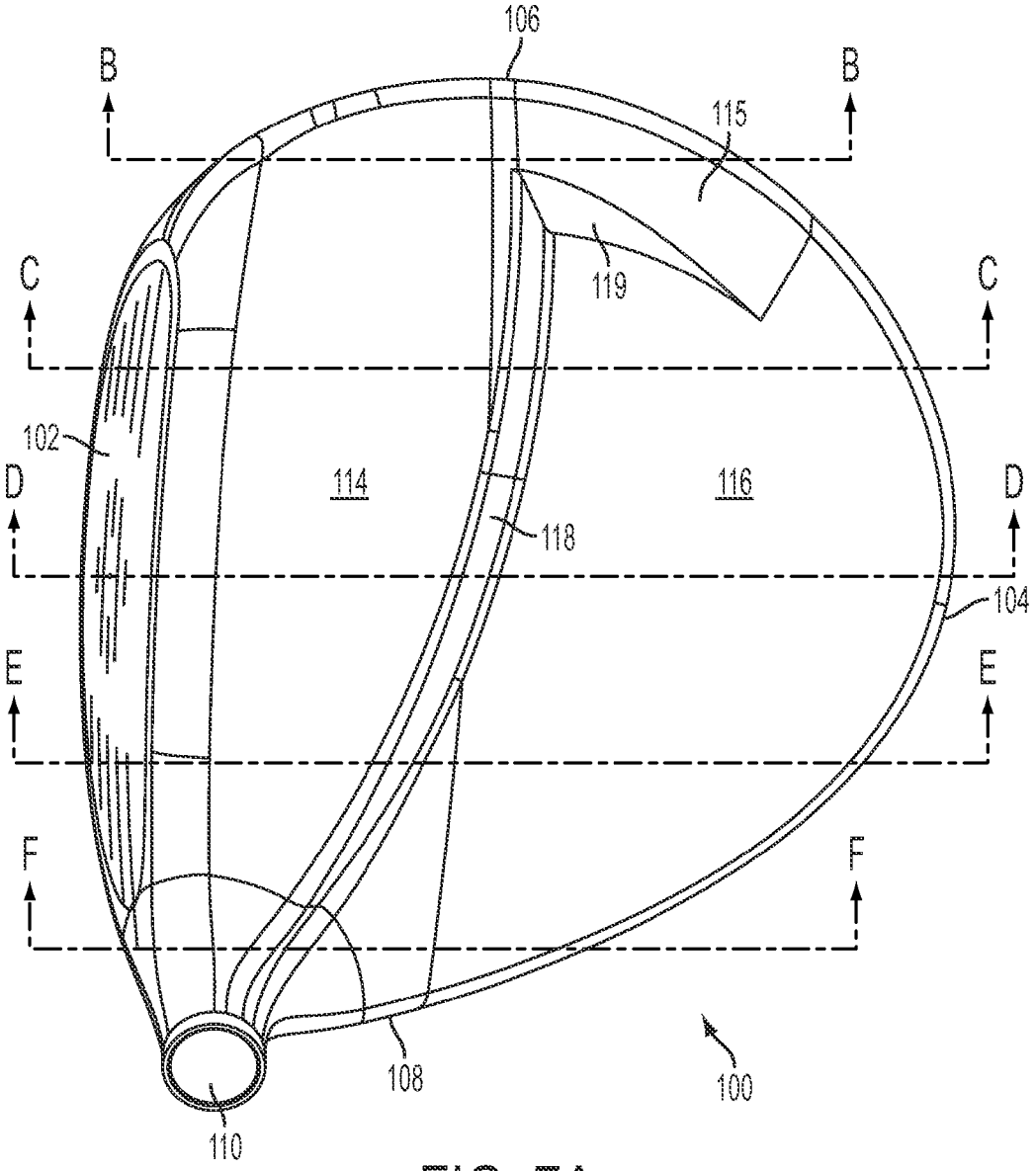
FIG. 7A is a top view of the exemplary golf club head of FIG. 1.
Figure 7B:
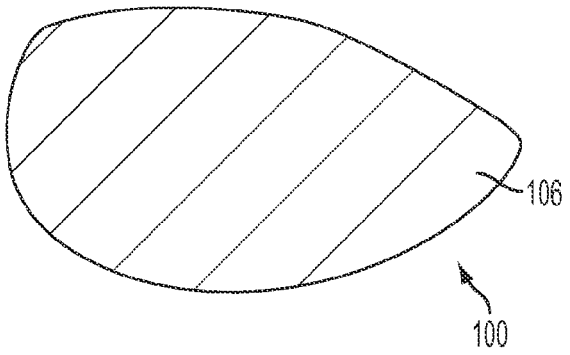
FIGS. 7B-7F are cross-sectional views of the exemplary golf club head taken along respective section lines of FIG. 7A.
Figure 7C:
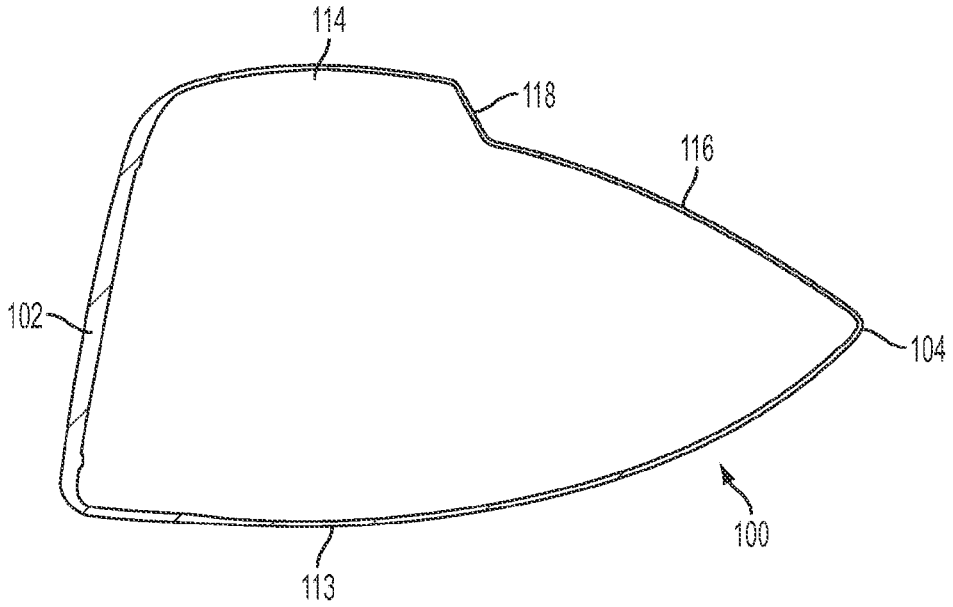
Figure 7D:
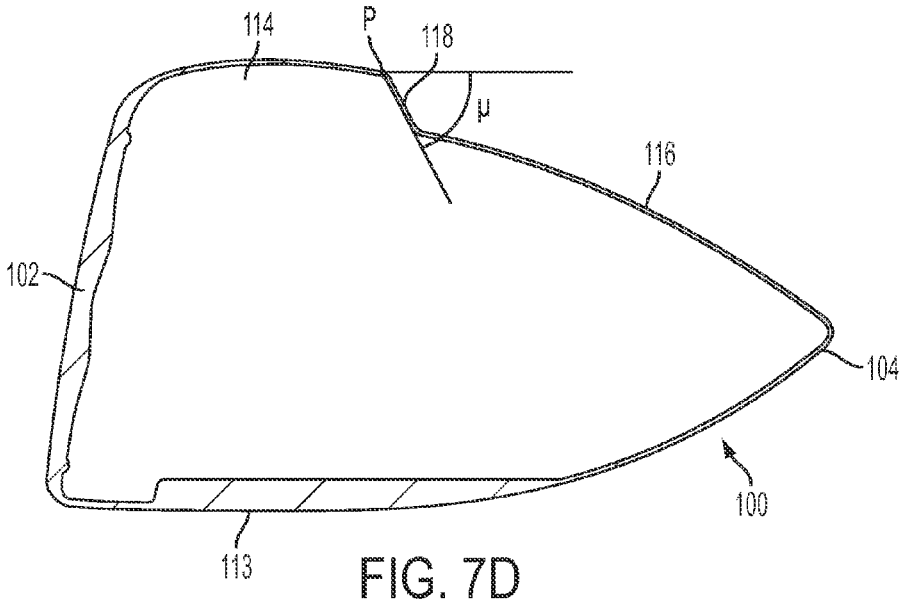
Figure 7E:
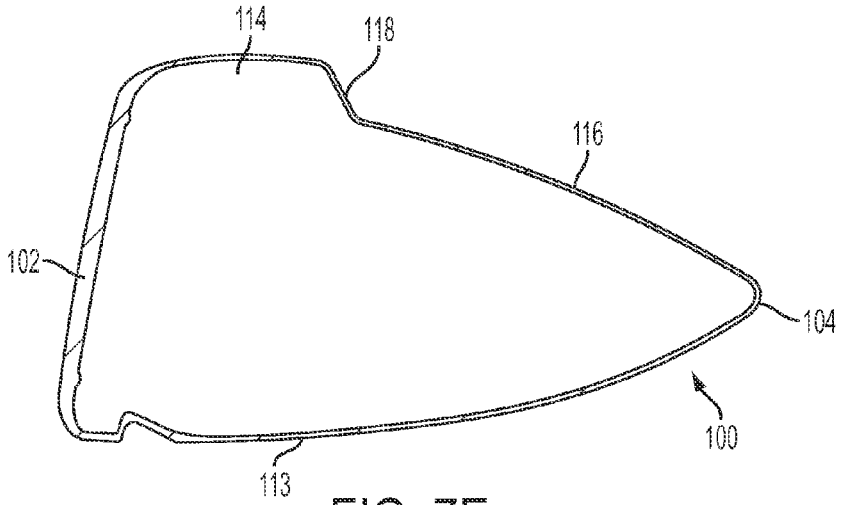
Figure 7F:
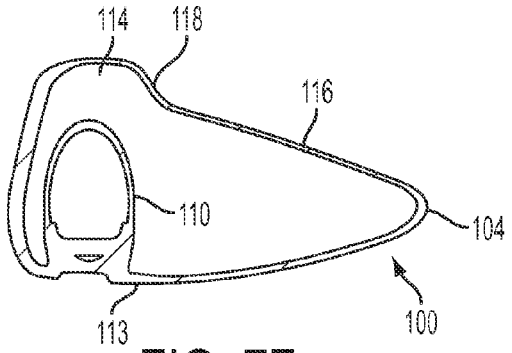

FIG. 7A shows a top view of the exemplary golf club head 100 and indicates the relevant planes for cross-sectional views presented in subsequent FIGS. 7B-7F. As shown in FIG. 7B, a cross-section of the exemplary club head 100 toward the toe 106 does not encompass the stepped portion 118. For the remaining cross sections shown in FIGS. 7C-7F, the stepped portion 118 is shown as a relatively steep transition in slope from the higher front portion 114 down to the lower rear portion 116.

EXAMPLE 2

FIGS. 8A-9J depict another exemplary golf club head 200 that comprises a striking face 202, a rear end 204, a toe 206, a heel 208, a hosel 210, and a crown 212 having a front portion 214, a rear portion 216, and a stepped portion 218. As shown in FIG. 8B, the stepped portion 218 extends along a substantially straight path in a toeward and rearward direction from near the hosel 210 to a point T adjacent to the toe 206. In the embodiment shown, the angle α of the rearward and toeward course of the stepped portion 218 at the point S (x=0) is about 30° relative to the x-z plane. In the embodiment shown, the front-to-rear distance $D_{sp}$ along the y-axis from the center-top of the striking face at x=0 to the point S at the front edge of stepped portion at x=0 is about 40 mm. The width $W_1$ of the striking face 102 along the x-axis is about 90 mm and the overall front-to-rear distance along the y-axis of the club head 200 is about 120 mm.

Figure 8C:
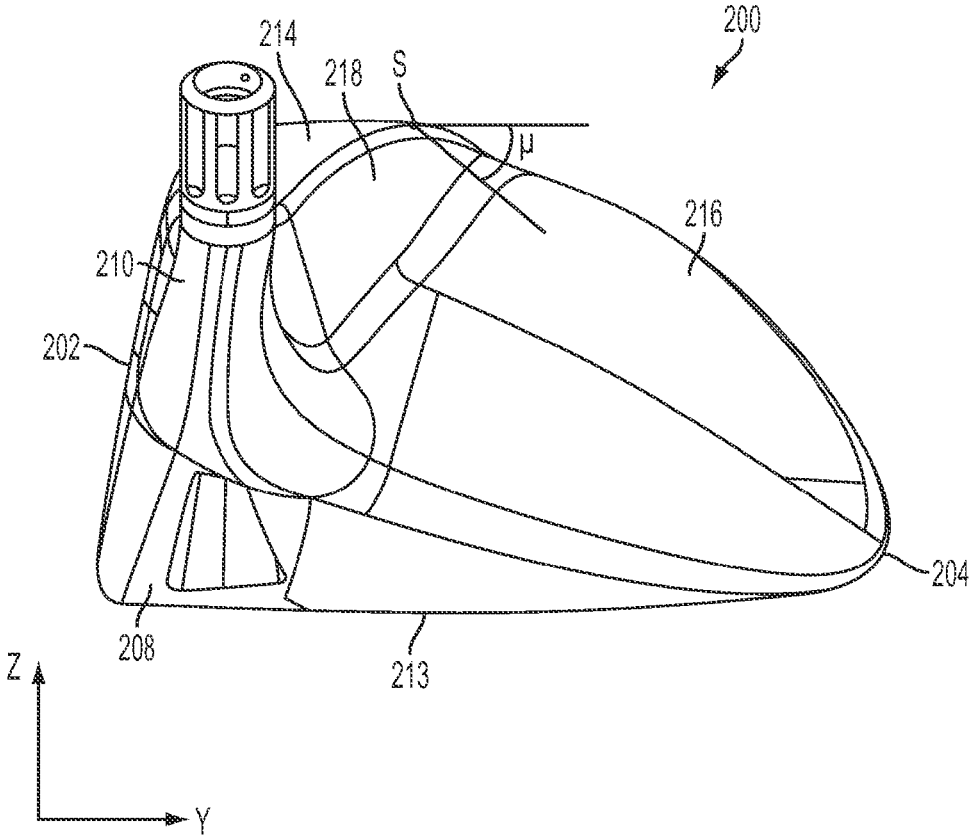
FIG. 8C is a heel side view of the golf club head of FIG. 8A.

FIG. 8C is a toe-side elevation view showing the slope of the crown 212. As shown in FIG. 8C, the stepped portion 218 of the crown 212 falls off at a relatively steep angle of declination μ relative to the relatively smaller slope of the adjacent portion of front portion 214 of the crown and the relatively smaller slope of the rear portion of the crown 216. In the embodiment 200, the rear end 204 of the club head is significantly lower to the ground in the z-axis compared to the embodiment 100 (FIG. 4). This lowered rear end 204 can provide an even lower CGz compared to the embodiment 100.

As shown in FIG. 8A, with the golf club head 200 resting on a ground surface in the address position, a highest point F of the striking face 212 has a height $H_1$ above the ground surface and the highest point A of the front portion 214 has a height $H_2$ above the ground surface. The highest point F of the striking face 202 and the highest point A on the crown 212 are located closer to toe 206 of the club head 200 than the heel 208.

Figure 9D:
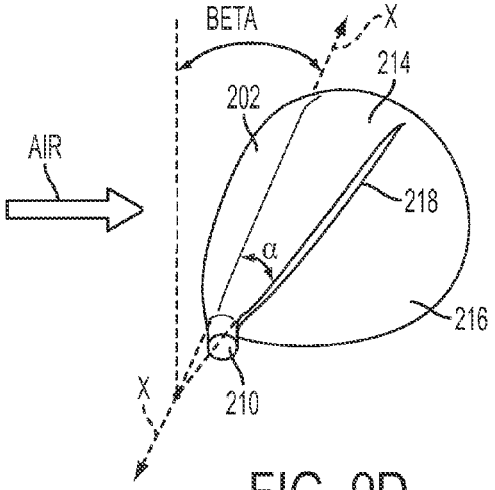
FIG. 9D is a top view of the golf club head of FIG. 8A at the second beta angle.
Figure 9E:
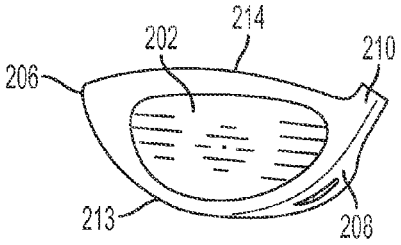
FIG. 9E is a profile view of the golf club head of FIG. 8A in the direction of relative air motion at a third beta angle.
Figure 9F:
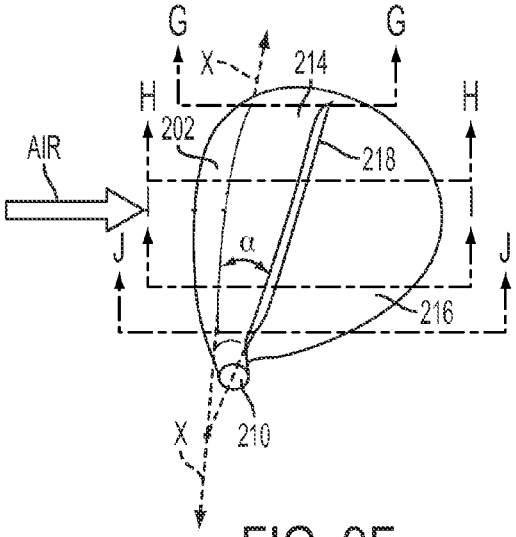
FIG. 9F is a top view of the golf club head of FIG. 8A at the third beta angle.
Figure 9G:
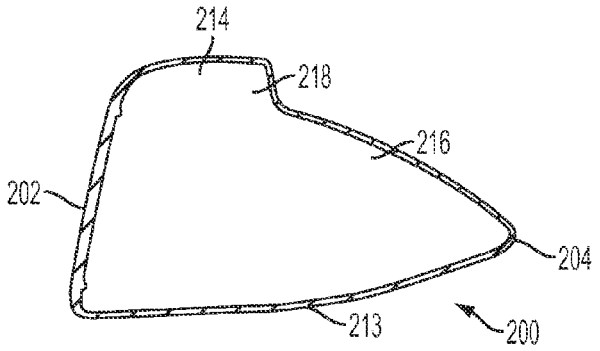
FIGS. 9G-9J are cross-sectional views of the alternate exemplary golf club head shown in FIG. 8A, taken along respective section lines shown in FIG. 9F.
Figure 9H:
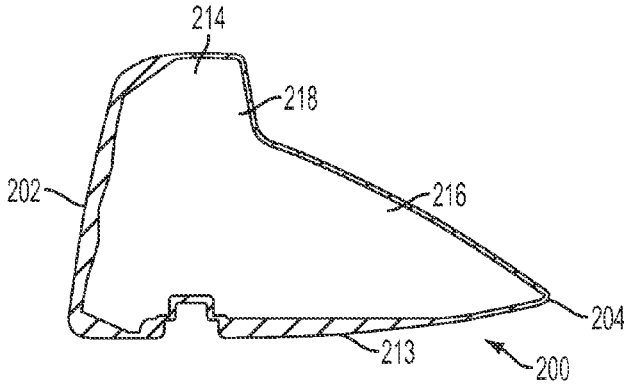
Figure 9I:
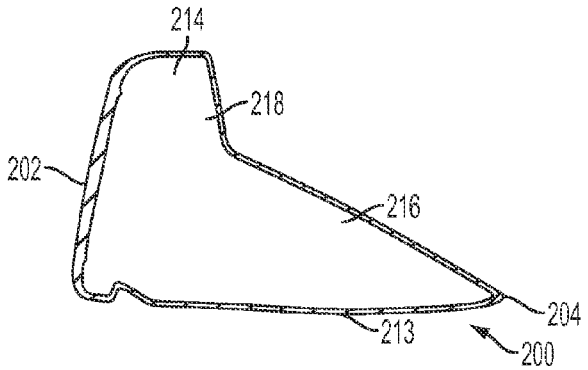
Figure 9J:
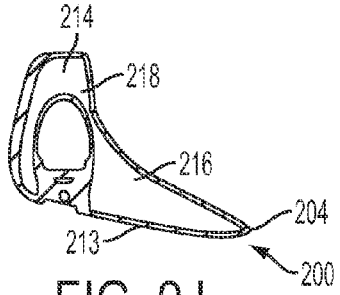

FIGS. 9A, 9C, and 9E show profile views of the club head 200 taken in the direction of motion of the club head at various points during a downswing. FIGS. 9B, 9D, and 9F show top views along the z-axis of the club head 200 in the three orientations shown in FIGS. 9A, 9C, and 9E, respectively. In FIGS. 9A, 9C, and 9E, the direction of motion of the air relative to the club head 200 is generally from the left to the right. In FIGS. 9A-9B, the club head 200 is at a beta angle of about 45°, which corresponds to the orientation in which the club head is traveling with the front-heel part of the club head leading the toe end of the club head. As a result of the stepped crown 212, the rear 204 of the club head 200, which is exposed to direct oncoming airflow, has a relatively thin profile and therefore presents reduced resistance to airflow. FIGS. 9C-9D show the club head 200 at a beta angle of about 30°, wherein the rear 204 of the club head 200, which is exposed to some direct oncoming airflow, has a relatively thin profile and therefore presents reduced resistance to airflow. FIGS. 9E-9F show the club head 200 at a beta angle of about 5-10°, corresponding to the orientation of the club head 200 with the face only slightly twisted about the z-axis relative to the direction of motion.

FIG. 9F shows a top view of the exemplary golf club head 200 and indicates the relevant planes for cross-sectional views presented in subsequent FIGS. 9G-9J. In each of the views of FIGS. 9G-9J, the stepped portion 218 is shown as a relatively steep transition in slope from the higher front portion 214 down to the lower rear portion 216. These views also show the low elevation of the rear end 204 of the club head 200.

For purposes of this description, certain aspects, advantages, and novel features of the embodiments of this disclosure are described herein. The disclosed embodiments should not be construed as limiting in any way. Instead, the present disclosure is directed toward all novel and nonobvious features and aspects of the various disclosed embodiments, alone and in various combinations and sub-combinations with one another. The methods, apparatuses, and systems are not limited to any specific aspect or feature or combination thereof, nor do the disclosed embodiments require that any one or more specific advantages be present or problems be solved.

As used herein, the terms "a", "an" and "at least one" encompass one or more of the specified element. That is, if two of a particular element are present, one of these elements is also present and thus "an" element is present. The terms "a plurality of" and "plural" mean two or more of the specified element. As used herein, the term "and/or" used between the last two of a list of elements means any one or more of the listed elements. For example, the phrase "A, B, and/or C" means "A," "B," "C," "A and B," "A and C," "B and C" or "A, B and C."

In view of the many possible embodiments to which the principles of this disclosure may be applied, it should be recognized that the illustrated embodiments are only preferred examples and should not be taken as limiting the scope of the inventions. Rather, the scope of the invention is defined by the following claims. We therefore claim all that comes within the scope and spirit of these claims.

We claim:

1. A golf club head comprising:

a front portion comprising a striking face, a rear end, a toe, a heel, a crown, a sole, and a hosel;

wherein the crown comprises front portion, a rear portion, and a stepped portion positioned between the front portion of the crown and the rear portion of the crown, wherein an external surface of the stepped portion of the crown has an angle of declination μ that is greater than an angle of declination μ of adjacent portions of the front portion and the rear portion;

wherein the stepped portion of the crown extends from a heelward side of the crown in a toeward and rearward direction that forms an average angle α of at least about 10° relative to a plane perpendicular to the y-axis;

wherein the golf club head has a center of gravity has a z-coordinate of less than or equal to −1.4 mm; and wherein an aerodynamic drag of the club head is about 1000 grams or less when air speed is 120 mph at a pitch angle of 0° and a beta angle of 20°.

2. The golf club head of claim 1, wherein stepped portion of the crown extends in a toeward and rearward direction that forms an average angle α of at least about 20° relative to a plane perpendicular to the y-axis.

3. The golf club head of claim 1, wherein the center of gravity has a z-coordinate of less than or equal to about −3.0 mm.

4. The golf club head of claim 1, wherein the center of gravity has a z-coordinate of less than or equal to about −5.0 mm.

5. The golf club head of claim 1, wherein, with the golf club head resting on a horizontal planar ground surface in the address position, a highest point of the striking face has a first height in the z-axis above the ground surface and a highest point of the crown has a second height in the z-axis above the ground surface, and the ratio of the second height divided by the first height is at least about 1.21.

6. The golf club head of claim 1, wherein the external surfaces of the front portion of the crown and the rear portion of the crown are non-concave.

7. The golf club head of claim 1, wherein a front edge of the stepped portion of the crown at an x-coordinate of zero has a y-coordinate of at least about 20 mm.

8. The golf club head of claim 1, wherein a front edge of the stepped portion of the crown at an x-coordinate of zero has a y-coordinate of at least about 40 mm.

9. A golf club head comprising:

a front portion comprising a striking face, a rear end, a toe, a heel, a crown, a sole, and a hosel;

wherein the crown comprises front portion, a rear portion, and a stepped portion positioned between the front portion of the crown and the rear portion of the crown, wherein the stepped portion of the crown provides an abrupt decrease in height in the z-axis from the front portion of the crown down to the rear portion of the crown;

wherein the stepped portion of the crown extends from a heelward side of the crown in a toeward and rearward direction that forms an average angle α of at least about 10° relative to a plane perpendicular to the y-axis;

with the golf club head resting on a horizontal planar ground surface in the address position, a highest point of the striking face has a first height in the z-axis above the ground surface and a highest point of the crown has a second height in the z-axis above the ground surface, and the ratio of the second height divided by the first height is at least about 1.13; and wherein an aerodynamic drag of the club head is about 1000 grams or less when air speed is 120 mph at a pitch angle of 0° and a beta angle of 20°.

10. The golf club head of claim 9, wherein stepped portion of the crown extends in a toeward and rearward direction that forms an average angle α of at least about 20° relative to a plane perpendicular to the y-axis.

11. The golf club head of claim 9, wherein the center of gravity has a z-coordinate of less than or equal to about −3.0 mm.

12. The golf club head of claim 9, wherein the center of gravity has a z-coordinate of less than or equal to about −5.0 mm.

13. The golf club head of claim 9, wherein the external surfaces of the front portion of the crown and the rear portion of the crown are non-concave.

14. The golf club head of claim 9, wherein a front edge of the stepped portion of the crown at an x-coordinate of zero has a y-coordinate of at least about 20 mm.

15. The golf club head of claim 9, wherein a front edge of the stepped portion of the crown at an x-coordinate of zero has a y-coordinate of at least about 40 mm.

16. The golf club head of claim 1, wherein the stepped portion of the crown extends in a toeward and rearward direction that forms an average angle α of at least about 30° relative to a plane perpendicular to the y-axis.

17. The golf club head of claim 9, wherein the stepped portion of the crown extends in a toeward and rearward direction that forms an average angle α of at least about 30° relative to a plane perpendicular to the y-axis.

* * * * *